US005306000A

United States Patent [19]

Comella

[11] Patent Number: 5,306,000

[45] Date of Patent: Apr. 26, 1994

[54] GOLF TOOL

[76] Inventor: John H. Comella, 1702 N. Dove Tail Dr., Ft. Pierce, Fla. 34982

[21] Appl. No.: 12,768

[22] Filed: Feb. 3, 1993

[51] Int. Cl.[5] ..... A63B 57/00; A63B 47/02; A63B 47/04

[52] U.S. Cl. ..... 273/32.5; 294/19.2; 273/201; 273/212; 273/32 B; 273/33; 15/21.2; 15/106

[58] Field of Search ..... 273/162 E, 32 B, 208, 273/201, 32.5, 32 D, 32 F, 162 F, 33; 15/105, 106, 21.2; 294/19.2

[56] References Cited

U.S. PATENT DOCUMENTS 3,462,184 8/1969 Russell ..... 273/162 E X
4,683,603 8/1987 Purlia et al. ..... 273/32 B X
4,799,684 1/1989 Rango ..... 273/32 B X
5,211,395 5/1993 Liao ..... 273/208 X

*Primary Examiner*—George J. Marlo
*Attorney, Agent, or Firm*—Leon Gilden

[57] ABSTRACT

A tool arranged for employment in a golfing game includes a tubular housing having a spike at a first end of the housing, and a cap mounted to the second end of the housing, with the cap removably mounted relative to the second end to receive a circular tee member arranged for receiving a golf ball thereon arranged for projection through the tube for positioning upon an underlying ground surface. The cap structure includes spaced semi-cylindrical flanges in facing relationship relative to one another coaxially aligned relative to the cap and the housing for resiliently grasping a golf ball therebetween as the flanges are arranged in a spring biased relationship towards one another.

6 Claims, 4 Drawing Sheets

GOLF TOOL

BACKGROUND OF THE INVENTION

1. Field of the Invention

The field of invention relates to golfing tool structure, and more particularly pertains to a new and improved golf tool wherein the same is arranged for the positioning of a golf ball on a golf tee on an underlying golf surface and structured to arranged for the lifting of the tee subsequent to its use.

2. Description of the Prior Art

Golfing tool structure of various types have been utilized throughout the prior art, such as indicated in U.S. Pat. Nos. 4,007,928; 4,787,632; 4,475,676; 5,042,812; and 4,960,239.

The instant invention attempts to overcome deficiencies of the prior art by providing for a structure arranged for the positioning of a golf ball upon a golf tee and the subsequent lifting of the golf tee and golf ball subsequent to use.

SUMMARY OF THE INVENTION

In view of the foregoing disadvantages inherent in the known types of golf tool structure now present in the prior art, the present invention provides a golf tool wherein the same is arranged for the positioning and subsequent removal of a golf ball and golf tee relative to a golfing surface. As such, the general purpose of the present invention, which will be described subsequently in greater detail, is to provide a new and improved golf tool which has all the advantages of the prior art golf tool apparatus and none of the disadvantages.

To attain this, the present invention provides a tool arranged for employment in a golfing game including a tubular housing having a spike at a first end of the housing, and a cap mounted to the second end of the housing, with the cap removably mounted relative to the second end to receive a circular tee member arranged for receiving a golf ball thereon arranged for projection through the tube for positioning upon an underlying ground surface. The cap structure includes spaced semicylindrical flanges in facing relationship relative to one another coaxially aligned relative to the cap and the housing for resiliently grasping a golf ball therebetween as the flanges are arranged in a spring biased relationship towards one another.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf tool which has all the advantages of the prior art golf tool apparatus and none of the disadvantages.

It is another object of the present invention to provide a new and improved golf tool which may be easily and efficiently manufactured and marketed.

It is a further object of the present invention to provide a new and improved golf tool which is of a durable and reliable construction.

An even further object of the present invention is to provide a new and improved golf tool which is susceptible of a low cost of manufacture with regard to both materials and labor, and which accordingly it then susceptible of low prices of sale to the consuming public, thereby making such golf tools economically available to the buying public.

Still yet another object of the present invention it to provide a new and improved golf tool which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
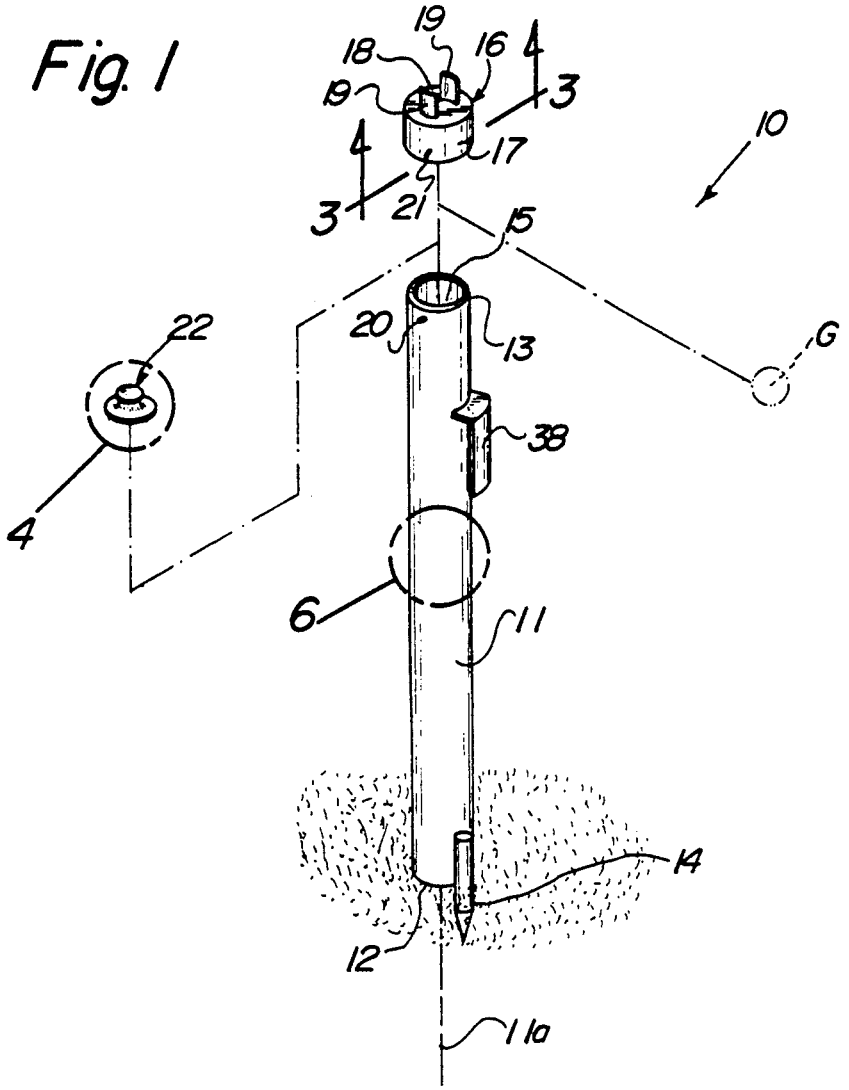
FIG. 1 is an isometric illustration of the invention.

With reference now to the drawings, and in particular to FIGS. 1 to 8 thereof, a new and improved golf tool embodying the principles and concepts of the present invention and generally designated by the reference numeral 10 will be described.

Figure 2:
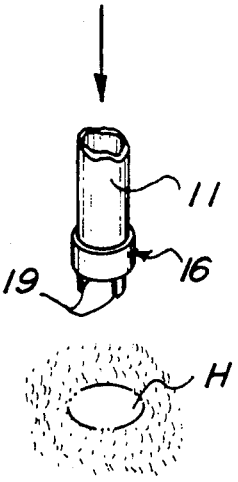
FIG. 2 is an isometric illustration of the golf ball lifting structure oriented for use.
Figure 3:
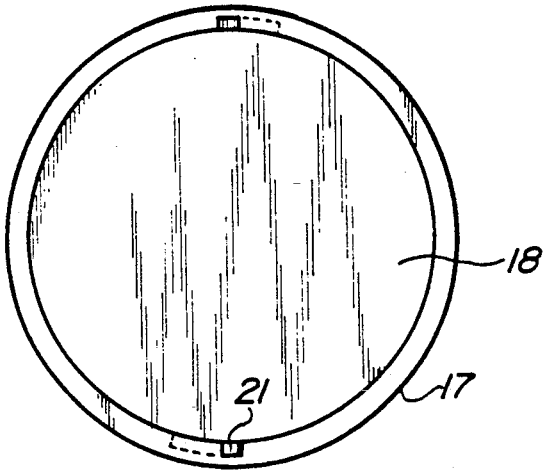
FIG. 3 is an orthographic view, taken along the lines 3—3 of FIG. 1 in the direction indicated by the arrows.
Figure 4:
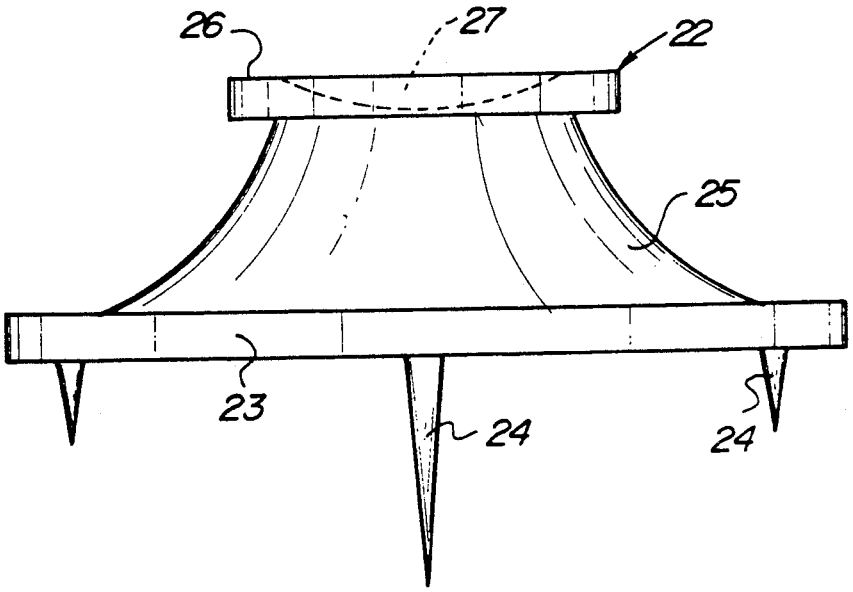
FIG. 4 is an orthographic view of section 4 as set forth in FIG. 1.
Figure 5:
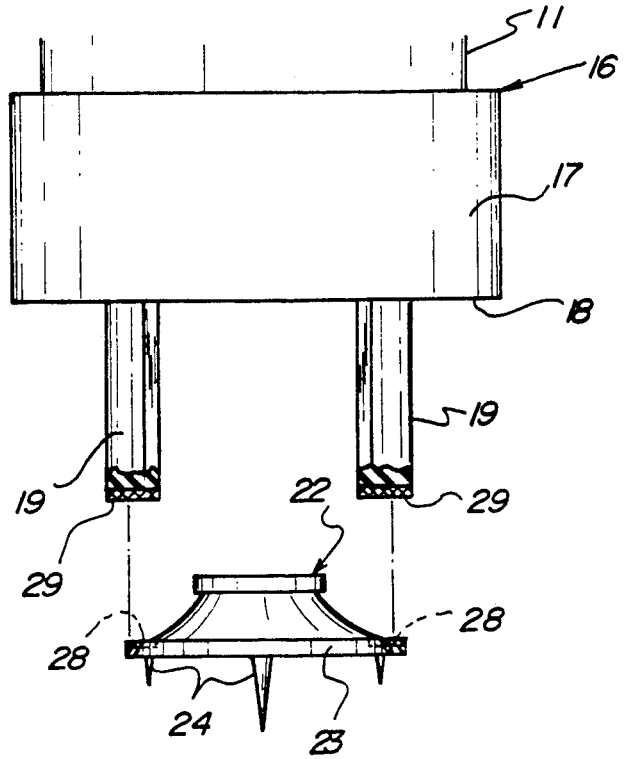
FIG. 5 is an orthographic view of the golf tee arranged for lifting relative to the housing cap structure.

More specifically, the golf tool 10 of the instant invention essentially comprises a cylindrical housing tube 11 coaxially aligned about a housing axis 11*a*. The tube 11 includes a first end 12 spaced from a second end 13. A first end spike 14 fixedly mounted to an exterior surface of the tube 11 projects below any beyond the first end 12 parallel to the axis 11*a* for projection and anchoring of the tube structure relative to the underlying golfing surface. A housing cavity 15 is directed coextensively from the first end to the second end 13, with a second end cap 16 arranged for selective securement about the second end by utilization of a cylindrical skirt 17 having a plurality of keyhole slots 21 arranged for registration with associated locking tabs 20. The cap 16 includes a top wall 18 having a plurality of spaced semi-cylindrical flanges 19 concentric about the axis 11*a* orthogonally mounted to the top wall 18. The flanges 19 are arranged in a spring biased relationship towards one another to arrange for grasping of a golf ball "G" therebetween, wherein the golf ball is received between the flanges 19 or when the flange is directed into a golf target hole "H", as indicated in FIG. 2.

A golf tee member 22 is provided, having a base plate 23 mounting orthogonally a plurality of conical spikes 24. A central truncated conical riser 25 extends from the base plate 23 to a roof plate 26, wherein the roof plate has a semi-cylindrical cavity 27 for receiving a golf ball "G" thereon. Typically, the tee member 22 is directed into the housing tube 11 from the second end 13 directed throughout the cavity 15 for positioning upon an underlying support surface, with the golf ball "G" directed thereon for reception within the cavity 27.

A plurality of ferrous metallic inserts 28 are positioned within the base plate 23, with the inserts 28 arranged for magnetic adherence to ferromagnetic tip members 29 positioned upon distal ends of each the flanges 19. In this manner, lifting of the tee member by the cap structure 16 when positioned upon the tube 11 is provided.

Figure 6:
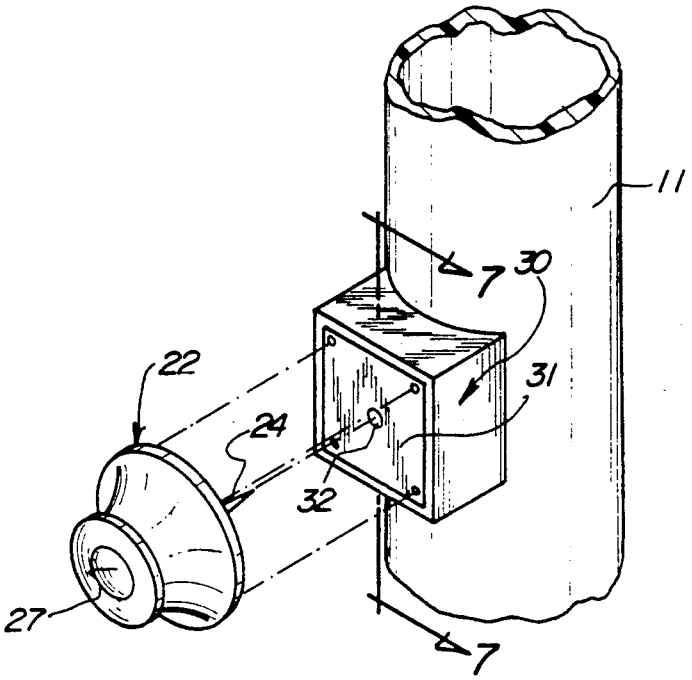
FIG. 6 is an isometric illustration of section 6 as set forth in FIG. 1.
Figure 7:
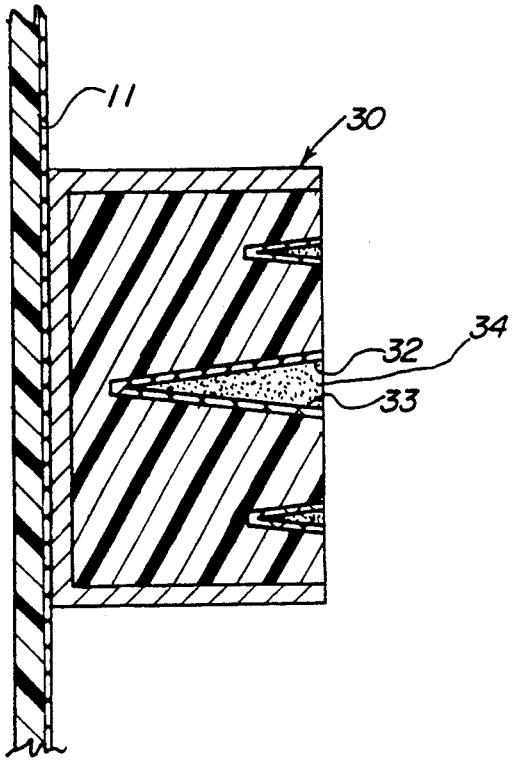
FIG. 7 is an orthographic view, taken along the lines 7—7 of FIG. 6 in the direction indicated by the arrows.
Figure 8:
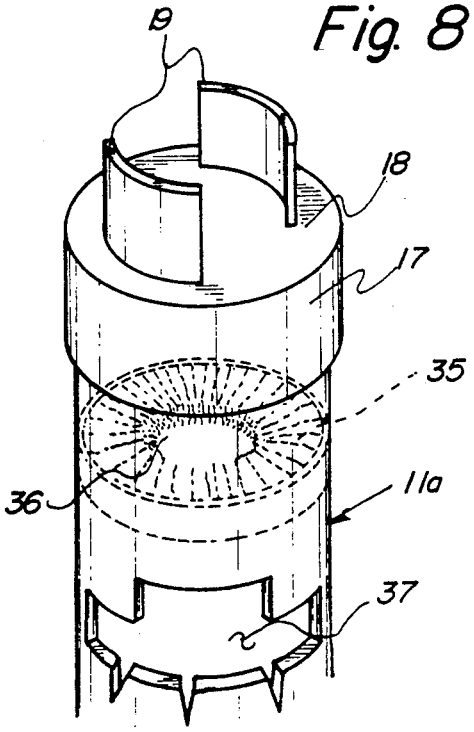
FIG. 8 is an isometric illustration of a modified housing structure including a golf ball brush mounted therewithin.

The FIG. 6 indicates the use of a golf tee support housing 30 mounted to an exterior surface of the housing tube 11, with the support housing 11 including an end wall 31, including a plurality of end wall conical cavities 32 directed into the housing orthogonally oriented relative to the axis 11*a*. Each of the conical cavities 32 (see FIG. 7) includes a magnetic wall liner 33 having a roughened interior surface 34 to provide for simultaneous adherence and sharpening of each of the spikes 24 directed into the conical cavities 32.

The further use of an annular brush 35 fixedly mounted within the housing tube 11 at the second end 13, to include a brush central opening 36 to clean a golf ball when directed therethrough. In this construction of the modified housing 11*a*, a T-shaped golf tee receiving slot 37 is directed through the housing in adjacency to the second end below the brush 35. Further, as indicated in FIG. 1, a handle 38 of L-shaped construction or of any suitable construction as desired is mounted to the housing tube 11 fixedly for ease of transport of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf tool, comprising, an elongate cylindrical housing tube symmetrically oriented about a predetermined axis, with the tube having a first end spaced from a second end, and a housing cavity directed coextensively from the first end through the second end, and a golf tee member, the golf tee member including a base plate complementarily received through the housing tube, the base plate having a plurality of base plate spikes fixedly and orthogonally mounted to the base plate extending to a roof plate, with the roof plate including a semi-spherical cavity for receiving a golf ball thereon, with the golf tee arranged for projection from the second end to the first end, and a golf tee member includes a central conical riser projecting from the base plate to the roof plate, and the second end includes a second end cap, the second end having latch means for securing the cap to the second end, and the cap including a cap top wall, the cap top wall having a plurality of diametrically opposed semi-cylindrical flanges resiliently biased towards one another symmetrically oriented about the predetermined axis for grasping a golf ball therebetween, the cap arranged for selective mounting to the first end when removed from the second end.

2. A golf tool as set forth in claim 1 wherein the flanges each include a magnetic tip member mounted to each free distal end of each flange, and the golf tee base plate having a plurality of ferrous metallic inserts, the magnetic tip member spaced apart a predetermined spacing and the inserts spaced apart said predetermined spacing on the base plate.

3. A golf tool as set forth in claim 2 wherein said spikes are formed of a ferrous metallic material and including a golf tee support housing fixedly mounted to the housing tube, where the support housing includes a support housing end wall, with the support housing end wall including a plurality of end wall conical cavities projecting into the support housing from the end wall, with each of the conical cavities including a magnetic wall liner for magnetic adherence to each of said spikes formed of a ferrous metallic material.

4. a golf tool as set forth in claim 3 wherein the magnetic wall liner includes a roughened interior surface for simultaneous sharpening of each spike upon projection of the spikes within the golf tee support housing.

5. A golf tool as set forth in claim 4 including an annular brush, wherein the annular brush is fixedly mounted to the housing tube at the second end, with the annular brush including a central opening to receive a golf ball therethrough, and a T-shaped golf tee receiving slot directed through the cylindrical housing adjacent the annular brush.

6. A golf tool as set forth in claim 5 including a handle member fixedly mounted to the housing tube adjacent the second end.

* * * * *